US010919141B2

(12) United States Patent
Omry et al.

(10) Patent No.: US 10,919,141 B2
(45) Date of Patent: Feb. 16, 2021

(54) CONTAINER WITH STOOL IN LID

(71) Applicant: The Stanley Works Israel Ltd., Rosh Ha'Ayin (IL)

(72) Inventors: Adar Omry, Hertzeliya (IL); Nir Joseph Evron, Yehud (IL); Miki Birnbaum, Rishon le Zion (IL); Shalom Saigauvker, Rosh Ha'Eyin (IL); Boaz Sarfati, Kiryat Ono (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 16/034,473

(22) Filed: Jul. 13, 2018

(65) Prior Publication Data

US 2020/0016737 A1 Jan. 16, 2020

(51) Int. Cl.

| | |
|---|---|
| ***A47C 13/00*** | (2006.01) |
| ***B25H 1/04*** | (2006.01) |
| ***B25H 3/02*** | (2006.01) |
| ***B25H 1/06*** | (2006.01) |

(52) U.S. Cl.

CPC ..... *B25H 3/02* (2013.01); *A47C 13/00* (2013.01); *B25H 1/04* (2013.01); *B25H 1/06* (2013.01)

(58) Field of Classification Search

CPC .. A45F 3/46; A47C 13/00; A47C 9/02; B25H 1/04; B25H 3/02; B25H 1/06; B65D 21/0209; B65D 51/249; B65D 81/3813; F25D 3/06; F25D 3/08

USPC ..... 206/45.2, 752, 764; 220/212, 592.03, 220/592.2, 915.2

See application file for complete search history.

(56) References Cited

U.S. PATENT DOCUMENTS

| | | | | |
|---|---|---|---|---|
| 1,451,846 A | | 4/1923 | Robinson | |
| 1,522,030 A | | 1/1925 | Robinson | |
| 2,225,512 A | | 12/1940 | Stiles | |
| 2,967,037 A | | 1/1961 | Christie | |
| 3,637,045 A | * | 1/1972 | Poffenbaugh | E04G 1/34 182/155 |
| 4,155,386 A | * | 5/1979 | Alessio | B25H 1/04 108/123 |
| 4,365,725 A | * | 12/1982 | Pfeifer | B65D 25/32 220/762 |

(Continued)

FOREIGN PATENT DOCUMENTS

| | | |
|---|---|---|
| BE | 900466 A | 12/1984 |
| CN | 2333505 | 8/1999 |
| EP | 1721546 A1 | 11/2006 |

OTHER PUBLICATIONS

Excerpt EP EESR, dated Nov. 18, 2019, in corresponding EP application No. 19185535.2.

*Primary Examiner* — Mollie Impink
(74) *Attorney, Agent, or Firm* — Bruce S. Shapiro

(57) ABSTRACT

The present application relates to a container or toolbox having a selectively removable lid. When the user is in need of a stool or step stool, she may unfold a leg assembly and step assembly contained within the lid. When the leg assembly is unfolded into its support position, the lid operates as a stool. Moreover, a step assembly may also be unfolded from the lid. In its deployed position, the step assembly provides an intermediate step beneath the upper surface of the lid. When the job is finished, the leg assembly and step assembly may be folded back into the lid such that the container may be used as a regular toolbox.

18 Claims, 9 Drawing Sheets

(56) References Cited

U.S. PATENT DOCUMENTS

| | | | | |
|---|---|---|---|---|
| 4,378,828 | A | 4/1983 | Shiminski | |
| 4,581,902 | A * | 4/1986 | Starck | A45C 9/00 190/11 |
| 5,366,071 | A | 11/1994 | Laszlo | |
| 5,535,683 | A | 7/1996 | Novak | |
| 5,713,468 | A | 2/1998 | Streichan | |
| 5,833,333 | A * | 11/1998 | Brown | A47B 83/00 312/235.1 |
| 6,068,355 | A | 5/2000 | Haworth | |
| 8,302,540 | B1 | 11/2012 | Niermeyer | |
| 8,496,289 | B2 | 7/2013 | Chen | |
| 8,616,354 | B2 | 12/2013 | Azirian | |
| 2005/0051940 | A1* | 3/2005 | Bensman | B25H 1/04 269/139 |
| 2006/0006628 | A1 | 1/2006 | Fields | |
| 2009/0078593 | A1 | 3/2009 | Patstone | |
| 2009/0236255 | A1* | 9/2009 | Piacenza | A47J 47/08 206/508 |
| 2010/0288585 | A1* | 11/2010 | Katz | B25H 1/04 182/155 |
| 2011/0168729 | A1* | 7/2011 | Koenig | A45C 13/26 220/761 |
| 2014/0262885 | A1* | 9/2014 | Green | B25H 3/02 206/372 |
| 2016/0183651 | A1 | 6/2016 | Tonelli | |
| 2017/0129097 | A1 | 5/2017 | Engvall | |
| 2018/0001466 | A1* | 1/2018 | Brunner | B25H 1/04 |
| 2018/0255911 | A1* | 9/2018 | Wang | A45C 11/20 |
| 2019/0001481 | A1* | 1/2019 | Faibish | B25H 1/04 |

* cited by examiner

CONTAINER WITH STOOL IN LID

FIELD OF THE INVENTION

The present application relates to a container that may function as a toolbox. More specifically, this application relates to a container that may function as both a toolbox and a stool/step stool.

BACKGROUND OF THE INVENTION

Carpenters and handy persons are often looking for new ways to protect, organize and transport their tools. Toolboxes have become a common way to achieve that task. However, at a jobsite, a carpenter may need to have her tools off the ground at a convenient accessible height. Having a stool would be helpful in such a situation. Likewise, a carpenter may also need a stool to work above her head. The use of a stool is often a common solution for these situations. However, transporting a stool to a jobsite in addition to a toolbox is an extra burden for the carpenter. It would be good to have a single product that functions as both a toolbox and a stool or step stool.

The present invention overcomes one or more of the drawbacks discussed above.

BRIEF SUMMARY OF THE INVENTION

The present application discloses a container having a body with a bottom connected a plurality of walls to define an interior space. The container also includes a lid having an upper surface connected to a plurality of walls to define a lid space. The lid is configured to engage the body to selectively provide or limit access to the interior space. The container also includes a leg assembly having a plurality of legs. The leg assembly is movable between a non-support position and a support position. When the leg assembly is in the non-support position it is disposed within the lid space. When the leg assembly is in the support position, the legs may engage a surface and provide support for the lid.

In another embodiment, the container may also include a step assembly that is movable between a stowed position and a deployed position. In the stowed position, the step assembly is disposed within the lid space. In the deployed position, the step assembly provides a step beneath the upper surface of the lid when the leg assembly is in the support position.

BRIEF DESCRIPTION OF THE DRAWINGS

An embodiment of the invention will now be described by way of example with reference to the drawings in which.

DETAILED DESCRIPTION OF THE INVENTION

Figure 1:
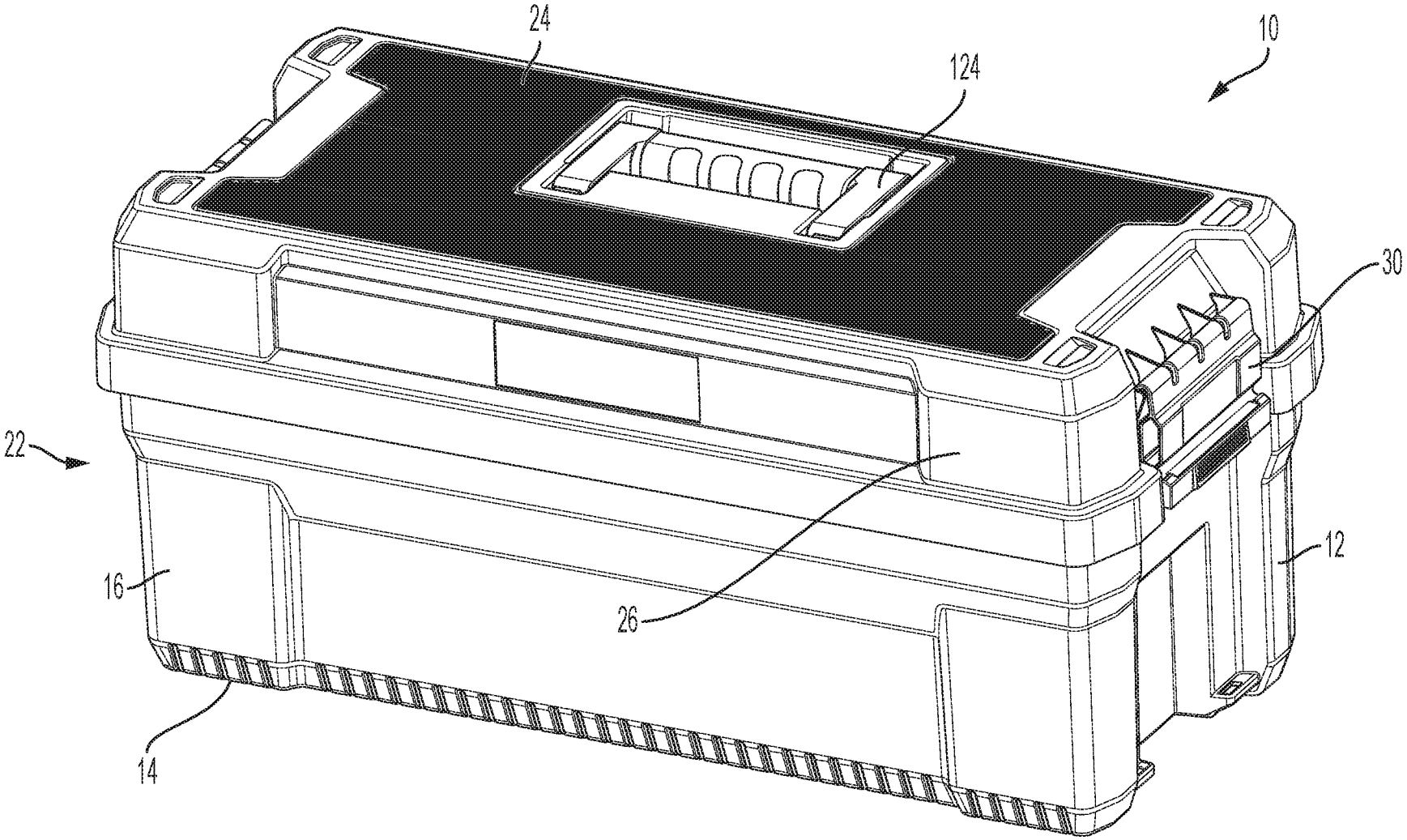
FIG. 1 is a perspective view of a closed container according to the invention.
Figure 5:
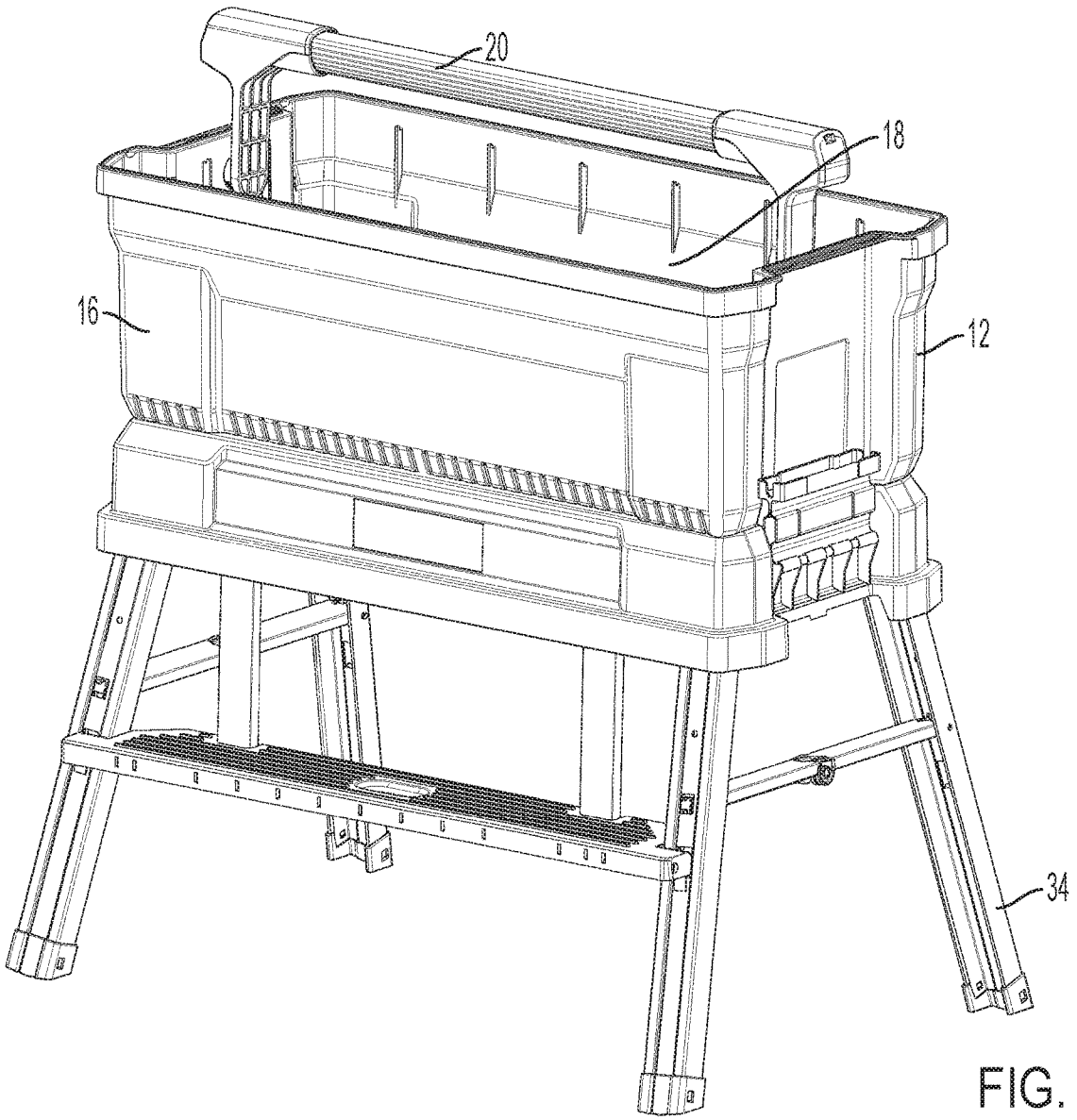
FIG. 5 is a perspective view of the step stool with the body latched thereto.

FIG. 1 discloses an embodiment of the container 10. Container 10 may be a toolbox suitable for use enclosing, transporting or protecting tools. Container 10 comprises a body 12, including a bottom 14 and a plurality of walls 16. As shown in FIG. 5, the body 12 defines an interior space 18. Body 12 may also include a tote handle 20 that may be rotatably engaged therein.

Returning to FIG. 1, container 10 also includes a lid 22. Lid 22 includes an upper surface 24 that is connected to a plurality of walls 26. As shown more clearly in FIG. 2, the upper surface 10 and plurality of walls 26 define a lid space 28. Lid 22 is configured to engage body 12 to selectively provide or limit access to the interior space 18. Lid 22 may engage body 12 by simply resting thereon or it may be actively secured thereto. FIG. 1 shows an embodiment where lid 22 is actively secured to body 12 with one or more latches 30. Those skilled in the art will recognize that there are a variety of different ways for lid 22 to engage body 12.

Figure 2:
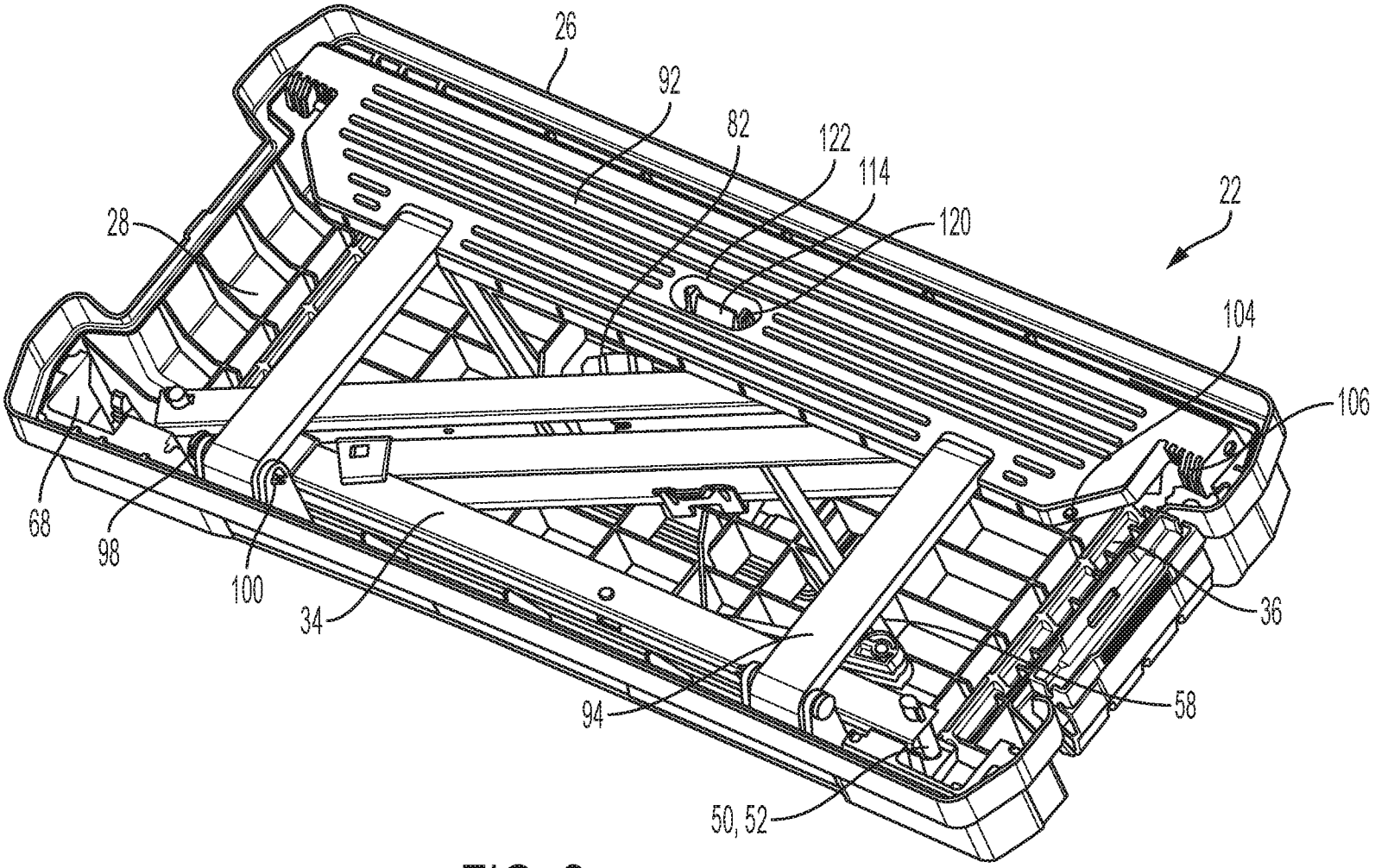
FIG. 2 is a detailed perspective view of the lid space with the leg assembly and step assembly disposed therein.
Figure 3:
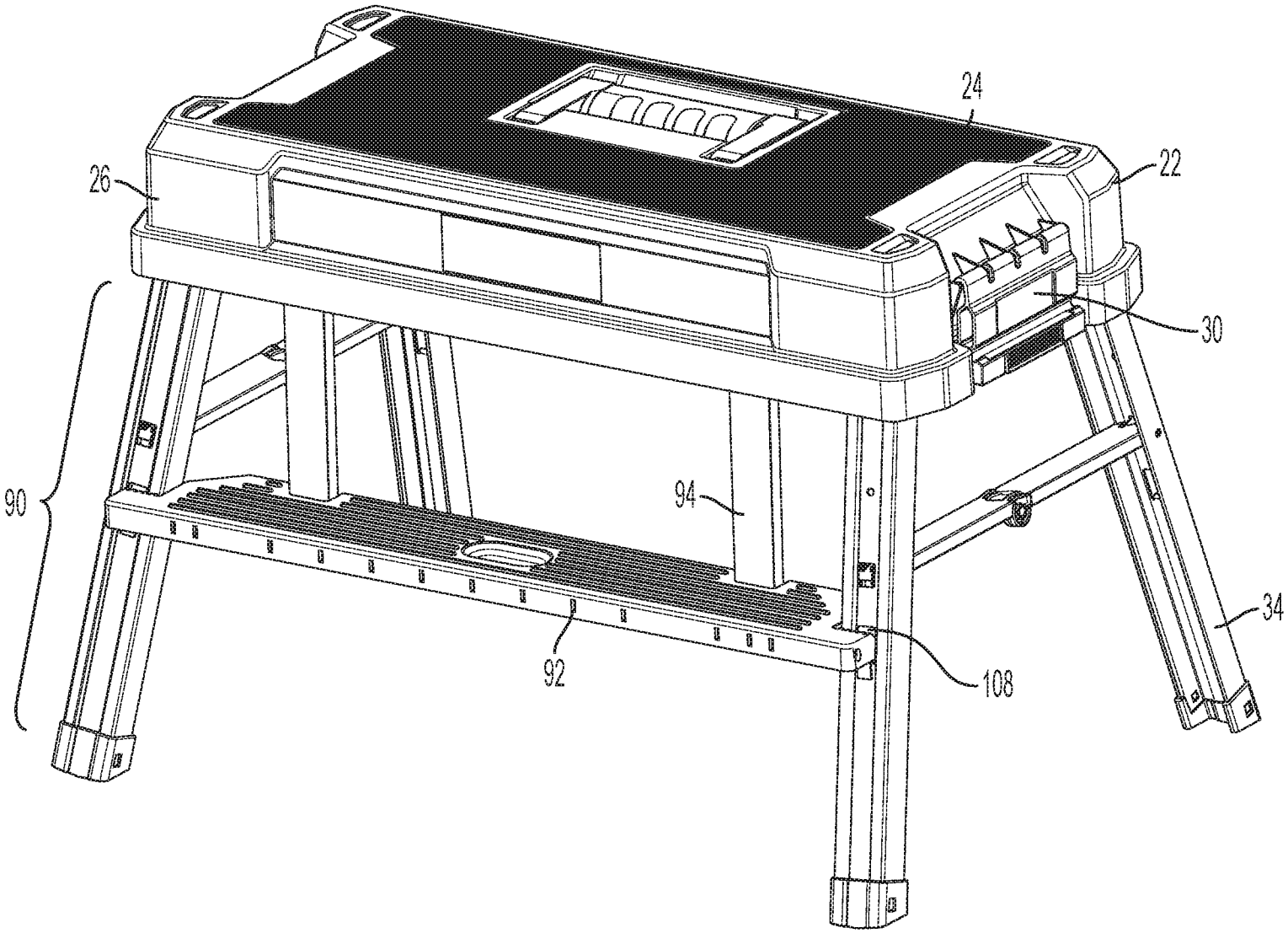
FIG. 3 is a perspective view of the top of step stool according to the invention.

Container 10 also includes a leg assembly 32 comprising a plurality of legs 34. Leg assembly 32 is movable between a non-support position and a support position. FIG. 2 shows leg assembly 32 in the non-support position wherein it is disposed within lid space 28. Conversely, as depicted in FIG. 3, when leg assembly 32 is in the support position, legs 34 may engage a surface (such as the ground or a floor) and provide support for the lid 22. Leg assembly 32 may further include a hinge 36. Hinge 36 may be disposed within the lid space 30 and be configured to engage two legs 34. Hinge 36 operates to facilitate movement of the leg assembly 32 between the non-support position and the support position.

Figure 6:
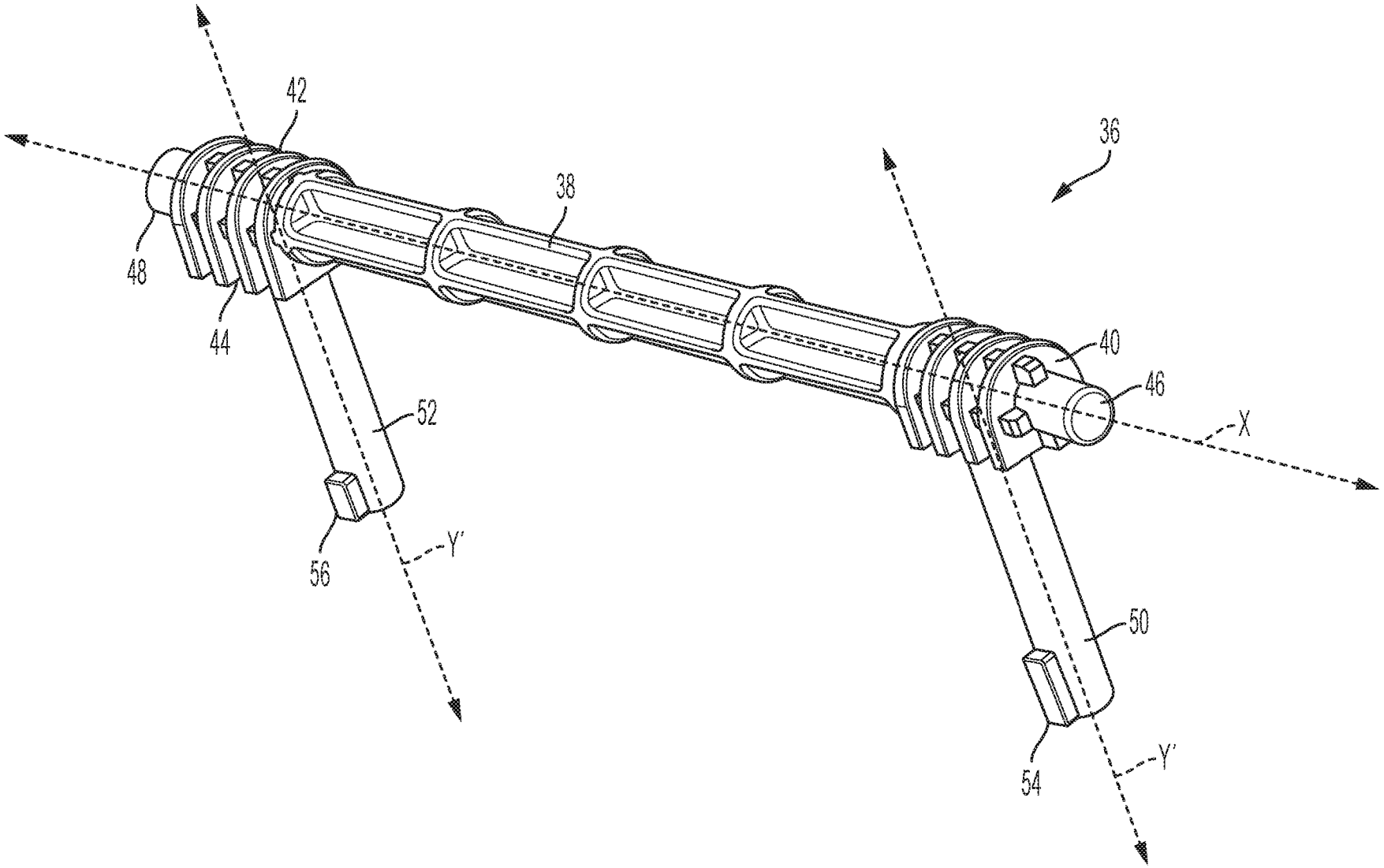
FIG. 6 is a perspective view of the triple axis hinge according to the invention.
Figure 7:
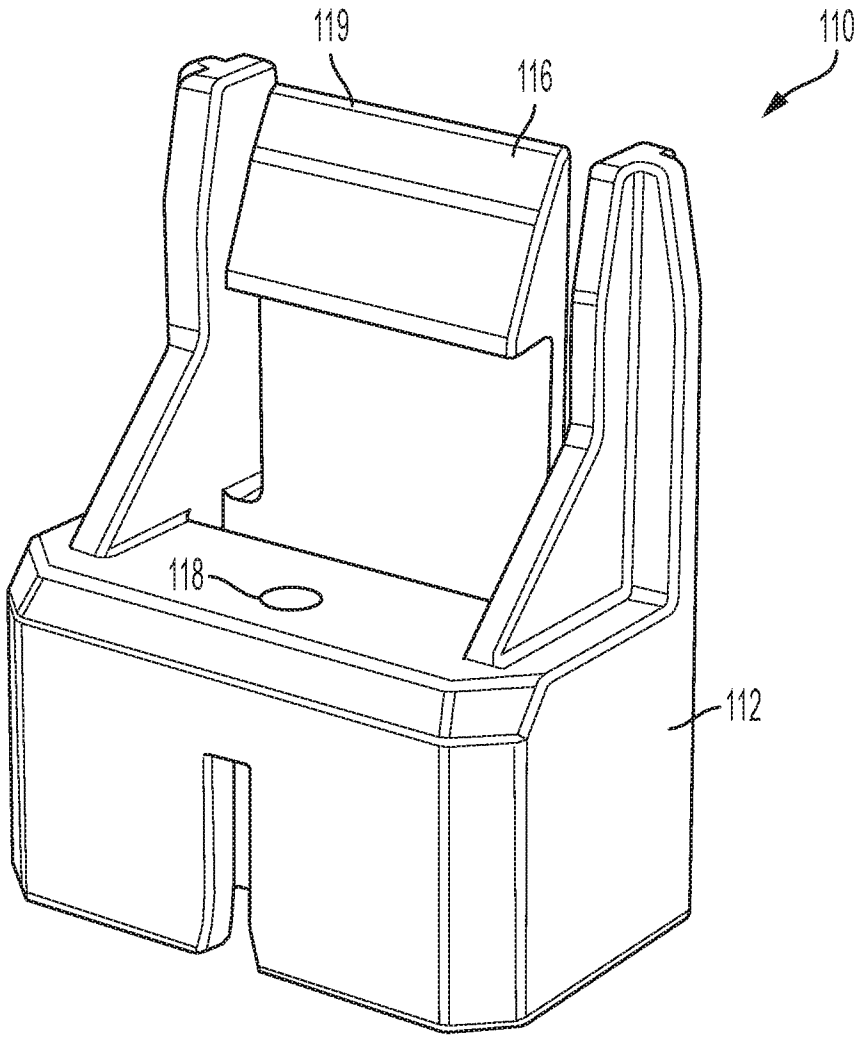
FIG. 7 is a perspective view of the step surface lock according to the invention.

As shown more clearly in FIG. 6, hinge 36 may be a so called "triple axis hinge". In a preferred embodiment, hinge 36 may include a main axle 38 having rotatable rib portions 40 adjacent to each end. The rotatable rib portions 40 include a rounded side 42 and a flat side 44. Main axle 38 along with the rotatable rib portion 40 share a first axis X. The respective ends 46, 48 of main axle 38 may serve as pins that facilitate the movement of main axle 38 around first axis X.

Hinge 36 also includes two leg axles 50, 52 that extend from the flat sides 44 of the rotatable rib portions 44. Leg axles 50 and 52 may further include protrusions 54, 56 which facilitate engagement to the respective legs 34. Leg axles 50, 52 respectively extend along second and third axes Y, Y'. Moreover, leg axles 50, 52 are positioned such that they are parallel to one another and perpendicular to main axle 38. It follows that second and third axes Y, Y' are also parallel to one another and perpendicular to first axis X.

Hinge 36 is considered to be a triple axis hinge because when legs 34 are connected thereto, movement along the first axis, second axis and third axis is possible. More specifically, the main axle facilitates simultaneous rotational movement of the legs about the first axis X, and leg axles 50, 52 allow the legs to be individually rotated about the respective second and third axes Y, Y'.

Figure 4:
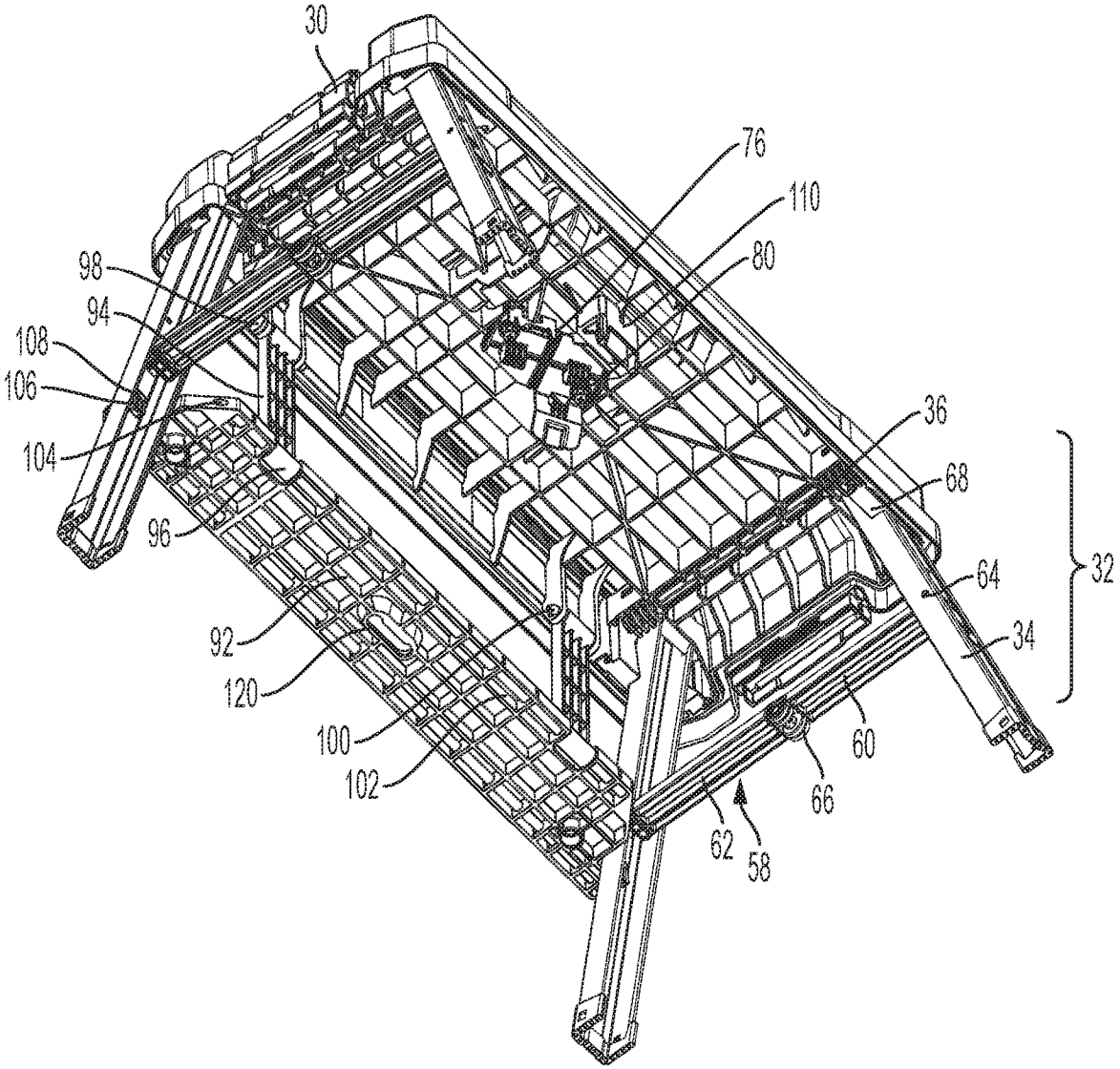
FIG. 4 is a perspective view of the bottom of the step stool according to the invention.

Leg assembly 32 may also include a foldable leg support 58 disposed between two legs 34. The foldable leg support is configured to be movable between a bent position and a horizontal position. As shown in FIG. 2, when the foldable leg support is in the bent position, the leg assembly may be in its non-support position. As shown in FIGS. 3, 4, and 5, when the foldable leg support 58 is in the horizontal position, the leg assembly 32 is secured in its support position. Foldable leg support 58 may comprise two identical links 60. Each link 60 includes a body portion 62 disposed between a leg engagement end 64 and link engagement end 66. The link engagement end 66 of the two links 60 are engaged to one another. The respective leg engagement ends 64 are each engaged to a leg 34. The leg engagement ends 64 and link engagement ends 66 allow movement of the foldable leg support between the bent position and the horizontal position.

Figure 8:
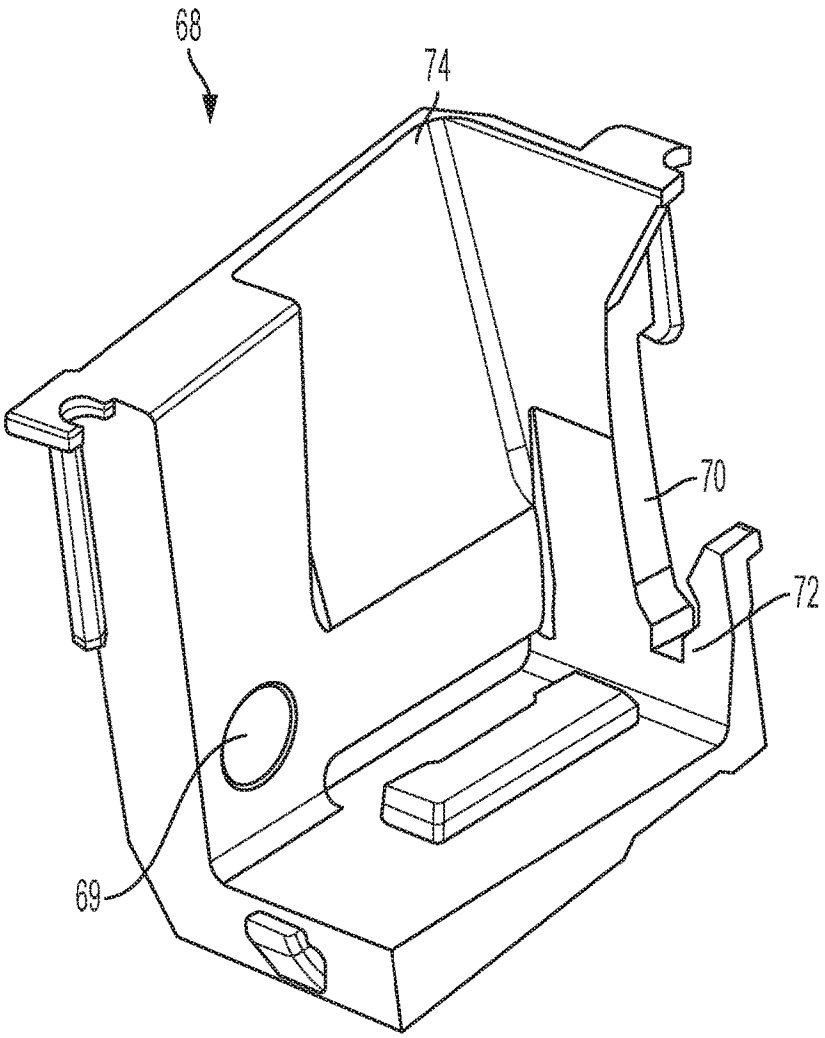
FIG. 8 is a perspective view of a corner support block according to the invention.
Figure 9:
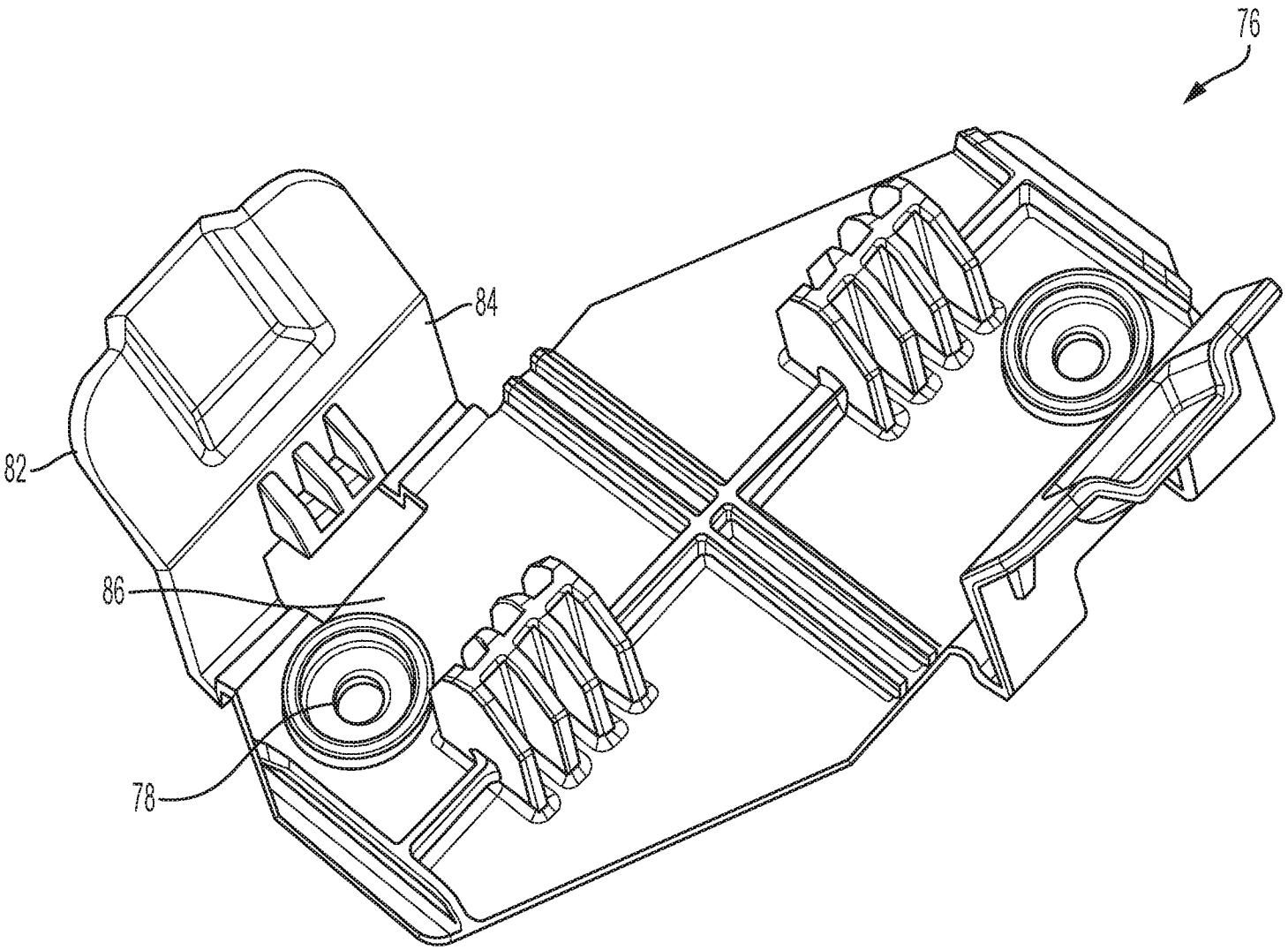
FIG. 9 is a perspective the leg snap lock according to the invention.

As best seen in FIGS. 2 and 8, leg assembly 32 may also include a support block 68. Support block 68 may be positioned within a corner of lid space 28 and configured to provide support to a leg 34 when the leg assembly 32 is in its support position. Support block 68 may include a pin depression 69. Pin depression 69 may be sized to receive ends 46, 48 of hinge 36. In receiving such ends 46, 48, pin depression 69 facilitates the rotational movement of hinge 36 around the X axis of main axle 38.

Support block 68 may be shaped to define a hinge receiving portion 70. By rotating hinge 36 about the X axis, the leg axle 50, 52 will come into contact with the hinge receiving portion 70. Hinge receiving portion 70 is configured to provide support to a leg axle 50, 52. Hinge receiving portion 70 may also include a locking carve out 72 that is configured to receive a protrusion 54, 56 of leg axle 50, 52. Locking carve out 72 is sized such that a protrusion 54, 56 may be secured by press fitting the same therein. By securing protrusion 54, 56 within locking carve out 72, the leg axle 50, 52 is also secured.

When a leg axle 50, 52 is secured within the hinge receiving portion 70, rotation of hinge 36 about the X axis is no longer possible. However, rotation of the legs 34 about the respective Y and Y' axes is still permissible. Legs 34 may be rotated about the Y, Y' axis until they come into contact with a leg receiving portion 74 of support block 68. Leg receiving portion 74 is configured to support a leg 34 when leg assembly 32 is in its support position. Leg receiving portion 74 may be sized such that leg 34 may be secured therein by press fitting. Once leg 34 is secured within the leg receiving portion 74, rotational movement of the leg about the Y, Y' axis is limited. Those skilled in the art will recognize that leg assembly 32 can be secured even further in this support position by moving the foldable leg support 58 into its horizontal position.

Leg assembly 32 may also include a leg snap 76. Leg snap 76, which may be disposed within the lid space 28, is configured to engage a leg 34 and secure leg assembly 32 in its non-support position. Leg snap 76 may define an opening 78 that is suitable for receiving a screw 80. As shown in FIG. 4, screw 80 may secure leg snap 76 to an interior surface of lid 22. Leg snap 76 may further include one or more bent tabs 82 that are configured to engage a surface of leg 34. When an operator wishes to dispose a leg 34 within the lid 22, she may fold the leg assembly 32 into its non-support position. By pressing the leg 34 against the bent tab 82, the bent tab may move slightly to allow a leg engaging edge 84 to come into securing contact with the leg. Applying additional pressure to the leg 34 will allow the leg to move into a locking space 86 defined between a central rib 88 and the bent tab 82. Once in the locking space 86, the leg engaging edge 84 secures the leg 34 in position. When it is desired to remove the leg assembly 32 from its non-support position, pressure may be applied to the bent tab 82 until the leg engaging edge 84 is out of contact with the leg 34. At which point, the leg 34 may be disengaged from the leg snap 76.

The container assembly 10 may further include a step assembly 90. Step assembly that is movable between a stowed position and a deployed position. As shown in FIG. 2, in the stowed position, the step assembly 90 is disposed within the lid space 28. In deployed position, the step assembly provides a step beneath the upper surface 24 of the lid 22 when the legs 34 are in their support position.

Step assembly 90 comprises a step surface 92 and at least one step hinge 94. Step hinge 94 facilitates movement of the step assembly 90 between the step assembly between stowed position and the deployed position. Step hinge 94 may be rotatably engaged to the lid 22 at one end and rotatably engaged to the step surface 92 at the other. To achieve this rotational engagement, step hinge 94 may define circular openings 96 at its respective ends. As shown in FIG. 4, the rotational engagement of the step hinge 94 to the lid 22 may be achieved by a pin 98 simultaneously disposed in circular opening 96 and an opening 100 in the lid. The rotational engagement of the step hinge 94 to the step surface 92 may be achieved by an axle 102 simultaneously disposed in the circular opening 96 and an opening 104 in the step surface 92.

Step surface 92 may further include leg engaging portions 106 that are configured to be received in a step receiving portion 108 of legs 34. As shown in FIGS. 2 and 4, Leg engaging portions 106 may be protrusions that extend from step surface 92. The step receiving portion 108 may be an opening within legs 34. When the step assembly 90 is in its deployed position, the protrusion 106 may come into locking contact with openings 108.

Step assembly 90 may further include a step surface lock 110. Step surface lock 110 may include a body 112 and a tab 114. Tab 114 may further include a step surface engaging portion 116. Step surface lock 110 is configured to be disposed within the lid space 28. Body 112 may define an opening 118. Opening 118 is may be suitable for receiving a screw to secure the step surface lock 110 to the interior surface of lid 22. Tab 114, and more specifically the step surface engaging portion 116 thereof is configured to engage an opening 120 in step surface 92. Step surface engaging portion 116 may be angled. When step assembly 90 is moved toward its stowed position, opening 120 is positioned such that tab 114 will be disposed therein. As step surface is pressed further within the lid space, an edge 122 that defines opening 120 will come into contact with the angled step surface engaging portion 116. As the operator applies additional pressure to the step surface, tab 114 will move out of the way until edge 122 moves under the step surface engaging portion 116. At this point, the step assembly 90 will be secured in its stowed position. When an operator desires to remove the step assembly 90 from its stowed position, pressure is applied to the tab 114 to allow edge 122 to disengage from underneath the step surface engaging portion 116. When this happens, the step assembly 90 may be moved from its stowed position toward its deployed position.

INDUSTRIAL APPLICABILITY

The container 10 described herein contains a body 12 defining an interior space 18 and a lid 22 defining a lid space 30. The container 10 also includes a leg assembly 32 disposed within the lid space 30. In a preferred embodiment, the container 10 also includes a step assembly 90 also disposed within the lid space 30. The interior space 18 of the body may be sized to hold a variety of tools. The lid 22 is configured to engage the body 12 to selectively provide or limit access to the tools contained within the interior space 18. When the lid 22 is engaged to the body 12 such that access is limited to the interior space 18, as seen in FIG. 1, the container 10 functions similar to a common toolbox. For example, using a handle 124, disposed on the upper surface 24, an operator may transport the entire container 10.

There may come a time when an operator is in need of a stool, and more specifically, a step stool. The lid 22 of the present disclosure is unique in that it can also function as a stool or a step stool. When an operator wishes to transform the lid 22 into a step stool, she will undo the latches 30 and remove the lid 22 from the body 12. As shown in FIG. 2, the leg assemblies 32 and step assembly 90 are in their non-support and stowed positions, respectively. In order to use the lid 22 as step stool, as seen in FIG. 3, the leg assemblies and step assembly need to be moved to their support and deployed positions, respectively.

By applying pressure on the tab 114 of the step surface lock 110, the step surface 92 may be disengaged from the step surface engaging portion 116. At this point, an operator can rotate the step surface 92 out of the lid space 18. Hinge 92 is configured to rotate at both the lid end the step surface end. At the lid end, this rotation is facilitated by a pin 98 coupled to an opening 96 in the hinge 92 and an opening 100 in the lid 22. At the step surface end, this rotation is achieved by an axle 102 disposed within both an opening 104 in the step surface 92 and another opening 96 in the hinge 94. The rotational movement allows the step assembly to be moved to its deployed position.

Moving the leg assembly 32 into its support position is a similar process. By applying pressure to the bent tab 82 of the leg snap 76, legs 34 may be disengaged from their secured position within the lid space. Once free, hinge 36 facilitates the movement of the leg assembly into its support position. In a preferred embodiment, hinge 36 is a triple axis hinge that is connected to two legs 34. The main axle 38 of hinge 36 allows the two legs 34 to simultaneously rotate about the X axis out of the lid space 18. As this rotation, leg axles 50, 52 of the hinge 36 will come into contact with the hinge receiving portion 70 of a support block 68. A protrusion 54, 56 on leg axles 50, 52 may engage a locking carve out 72 to secure the leg axles 50, 52 to the respective support blocks 68. Thereafter, legs 34 may be rotated individually about the Y and Y' axes of the leg axles. The legs may be rotated until they come into contact with leg receiving portions 74 of the support blocks 68. Leg receiving portions 74 may be sized to allow the legs to be secured therein by press fitting. When the legs 34 are engaged to the leg receiving portions 74, the legs are in their support position.

For added support a foldable leg support 58 may also be disposed between the legs 34. The foldable leg support 58 is configured to move between a bent position when the leg assembly 32 is in its non-support position and a horizontal position with the leg assembly 32 is in its support position. Once the legs 34 are in engaged to the leg receiving portions 74, an operator can apply pressure to the foldable leg support 58 and move the same into its horizontal position. Thus, leg assembly 32 is held even more securely in their support position.

When both the leg assembly and step assembly are in their respective support and deployed positions, leg engaging protrusions 106 on the step surface 92 may come into locking contact with openings 108 on legs 34 to provide added stability.

Those skilled in the art will recognize that the latch 30 may be configured to secure lid 22 to the body in a variety of different ways. For example, as shown in FIG. 1, the lid 22 may be connected to the body 12 such that the upper surface 24 of the lid is not in contact with the body. In this position, lid 22 limits access to interior space 18. Alternatively, as shown in FIG. 5, the latch 30 may engage the body 12 such that the upper surface 24 of the lid is in contact with the body. In this alternate position, lid 22 does not limit access to the interior space 18. Also, in this position, an operator may use the tote 20 to carry the container mechanism while it is in its step stool configuration.

While the present invention has been described in connection with what is considered the most practical and preferred embodiments, it is understood that this invention is not limited to the disclosed embodiments but is intended to cover various arrangement included within the spirit and scope of the broadest interpretation of the attached claims so as to encompass all such modifications and equivalent arrangements.

The invention claimed is:

1. A container comprising:

a body having a bottom connected to a plurality of walls and defining an interior space;

a lid having an upper surface connected to a plurality of lid walls and defining a lid space, wherein said lid is configured to engage the body to selectively provide or limit access to the interior space; and a leg assembly comprising a plurality of legs and movable between a non-support position and a support position, wherein in said non-support position, the leg assembly is disposed within the lid space, and in said support position, the legs are extended from and provide support for the lid;

a step assembly movable between a stowed position and a deployed position, wherein in said stowed position, the step assembly is disposed within the lid space and in said deployed position, the step assembly provides a step beneath the upper surface of the lid when the leg assembly is in the support position; wherein the step assembly further comprises a step surface and at least one step hinge rotatably engaged to the lid at one end and rotatably engaged to the step surface at the other end, and wherein the at least one step hinge facilitates movement of the step assembly between the stowed position and the deployed position.

2. The container assembly of claim 1, wherein the leg assembly further includes a foldable leg support disposed between two of said plurality of legs, and movable between a bent position and a horizontal position, wherein in said bent position, the leg assembly may be in the non-support position, and in said horizontal position, the leg assembly is secured in the support position, said foldable leg support including two identical links, wherein each of said links include a body portion disposed between a leg engagement end and a link engagement end, and wherein the link engagement ends of the two links are engaged to one another and the respective leg engagement ends are each engaged to one of the two of the plurality of legs, and wherein respective leg engagement ends and link engagement ends facilitate movement of the foldable leg support between the bent position and the horizontal position.

3. The container assembly of claim 1, wherein the rotatable engagement of the at least one step hinge to the lid is facilitated by a pin, and wherein the rotatable engagement of the at least one step hinge to the step surface is facilitated by an axle disposed within the step surface.

4. The container assembly of claim 1, wherein the step surface further includes a leg engaging portion and at least one of the plurality of legs includes a step surface receiving portion, wherein when said step assembly is in the deployed position, the leg engaging portion and step surface receiving portion are in contact with one another.

5. The container assembly of claim 4, wherein the leg engaging portion is a protrusion extending from the step surface, and wherein the step surface receiving portion is an opening within one of the plurality of legs.

6. A container comprising:

a body having a bottom connected to a plurality of walls and defining an interior space;

a lid having an upper surface connected to a plurality of lid walls and defining a lid space, wherein said lid is configured to engage the body to selectively provide or limit access to the interior space; and a leg assembly comprising two legs and a hinge, said legs movable between a non-support position in which the leg assembly is disposed within the lid space and a support position in which the legs are extended from and provide support for the lid, said hinge disposed within the lid space and including a main axle defining a first axis and two leg axles extending from said main axle substantially parallel to each other and substantially perpendicular to said main axle and defining second and third axes which are substantially parallel to each other and substantially perpendicular to the first axis, said main axle having rotatable rib portions adjacent each end, wherein, when said legs move between the non-support position and the support position said legs rotate simultaneously around the first axis and each of said legs rotates individually about one of the second axis and the third axis.

7. The container assembly of claim 6, wherein the leg assembly further includes at least one support block defining a hinge receiving portion and a leg receiving portion, wherein when one of the plurality of legs is in its support position, the hinge is disposed in the hinge receiving space and the leg is received in the leg receiving space.

8. The container assembly of claim 6, wherein the leg assembly further includes a leg snap disposed within the lid space and configured to engage at least one of the plurality of legs to selectively secure the leg assembly in its non-support position.

9. The container assembly of claim 6, further comprising a step assembly movable between a stowed position and a deployed position, wherein in said stowed position, the step assembly is disposed within the lid space and in said deployed position, the step assembly provides a step surface beneath the upper surface of the lid when the leg assembly is in the support position.

10. The container assembly of claim 9, wherein the step assembly further includes a step surface lock disposed within the lid and configured to engage the step surface to selectively secure the step surface in its stowed position.

11. The container assembly of claim 6, wherein the lid includes a latch configured to engage the body to secure the lid and body to one another, and wherein the latch engages the body such that the upper surface of the lid is not in contact with the body.

12. The container assembly of claim 6, wherein the upper surface of the lid further includes a handle.

13. The container of claim 6, each rotatable rib portion including a rounded side and a flat side; and said leg axles extend from the flat sides of the rotatable rib portions.

14. A container comprising:

a body having a bottom connected to a plurality of walls and defining an interior space;

a lid having an upper surface connected to a plurality of lid walls and defining a lid space, wherein said lid is configured to removably engage the body to selectively provide or limit access to the interior space, said lid including a latch configured to engage the body to secure the lid and body to one another when said lid is engaged on said body;

a leg assembly comprising a plurality of legs and movable between a non-support position and a support position, wherein in said non-support position, the leg assembly is disposed within the lid space, and in said support position said legs are extended from and provide support for the lid; and a step assembly movable between a stowed position in which the step assembly is disposed within the lid space and a deployed position in which the step assembly provides a step surface beneath the upper surface of the lid when the leg assembly is in the support position, said step assembly further including a step surface lock disposed within the lid and configured to engage the step surface to selectively secure the step surface in its stowed position; wherein, when said body is place on said lid with the bottom surface of said body resting on the upper surface of the lid, said latch is engagable to the body to secure the body and lid together with the interior space of the body accessible.

15. The container assembly of claim 14, wherein the body further includes a tote handle disposed within the interior space.

16. The container assembly of claim 15, wherein the tote handle is rotatably connected to the interior of two of the plurality of walls, and moveable between a folded position and a carrying position.

17. A container comprising:

a body having a bottom connected to a plurality of walls and defining an interior space;

a lid having an upper surface connected to a plurality of lid walls and defining a lid space, wherein said lid is configured to engage the body to selectively provide or limit access to the interior space; and a leg assembly comprising two legs and a hinge, said legs movable between a non-support position in which the leg assembly is disposed within the lid space and a support position in which the legs are extended from and provide support for the lid, said hinge disposed within the lid space and including a main axle defining a first axis and two leg axles extending from said main axle substantially parallel to each other and substantially perpendicular to and intersecting said main axle and defining second and third axes which are substantially parallel to each other and substantially perpendicular to the first axis, wherein, when said legs move between the non-support position and the support position said legs rotate simultaneously around the first axis and each of said legs rotates individually about one of the second axis and the third axis.

18. The container of claim 17, said main axle having opposite ends and a rounded pin extending from each end, said rounded pins rotatably received in said lid, said first axis extending through said rounded pins and defining a longitudinal rotational axis for said hinge.

* * * * *